United States Patent [19]

Fujii et al.

[11] Patent Number: 4,598,638

[45] Date of Patent: Jul. 8, 1986

[54] LATERAL PERFORATION VERTICAL REGISTRATION DEVICE FOR OFFSET PRESS

[75] Inventors: Yutaka Fujii; Takahiko Shinmoto, both of Hiroshima, Japan

[73] Assignee: Ryobi Ltd., Hiroshima, Japan

[21] Appl. No.: 707,251

[22] Filed: Mar. 1, 1985

[30] Foreign Application Priority Data

Mar. 2, 1984 [JP] Japan ..... 30970[U]

[51] Int. Cl.[4] ..... B41F 13/12; B41L 49/02; B41G 7/00

[52] U.S. Cl. ..... 101/76; 101/226

[58] Field of Search ..... 101/74, 75, 76, 77, 101/84, 85, 86, 87, 88, 89, 217, 218, 224, 226, 227, 216, DIG. 12, 248; 33/184.5; 83/522, 471.3, 473, 497, 699

[56] References Cited

U.S. PATENT DOCUMENTS 4,177,730 12/1979 Schriber et al. ..... 101/226 X 4,426,929 1/1984 Fujisawa et al. ..... 101/226 X

*Primary Examiner*—J. Reed Fisher

*Attorney, Agent, or Firm*—Sughrue, Mion, Zinn, Macpeak, and Seas

[57] ABSTRACT

A lateral perforation vertical registration device for an offset press in which the position of lateral perforations formed on printing sheets can be accurately set without the need for running a number of test sheets. A lateral perforating position reading plate is provided made of a transparent material and having both lateral and vertical scales. A printing sheet is placed on the perforating position reading plate prior to printing to determine the position of lateral perforating. A vertical scale provided on the outer peripheral surface of a numbering device mounting cylinder is then adjusted relative to a fixed pointer to correspond to the value read on the reading plate.

2 Claims, 4 Drawing Figures

LATERAL PERFORATION VERTICAL REGISTRATION DEVICE FOR OFFSET PRESS

BACKGROUND OF THE INVENTION

The present invention relates to a lateral perforation vertical registration device for use in connection with an offset press.

The lateral perforating device and typographic numbering device in an offset press generally include a transfer drum fixed to a mounting shaft of the lateral perforating device, an impression cylinder having an outer periphery in contact with that of the transfer drum, and a typographic numbering device mounting cylinder. With this arrangement, when a sheet of paper is supplied between the impression cylinder and the typographic numbering device mounting cylinder from the transfer drum, lateral perforation is effected by a perforating blade. The sheet is numbered as well.

However, in the conventional lateral perforating device as mentioned above, vertical registration of the lateral perforations must be effected while the paper is being fed. Such registration is difficult. Further, it is necessary to prepare test sheets for checking the perforation position prior to actual operation.

SUMMARY OF THE INVENTION

The present invention has been made to overcome the above-mentioned disadvantages present in the prior art lateral perforating device. Particularly, it is an object of the invention to provide a lateral perforation vertical registration device which enables rapid and precise registering of lateral perforations by an easy operation and with a shortened preparation time.

In accordance with the invention, the above and other objects are achieved by placing a lateral perforating position reading plate on a printing paper before lateral perforation is effected so as to read the position of the lateral perforations in the vertical direction, and, by adjusting pointers on a vertical scale plate provided at a printing machine and a lateral perforating device respectively corresponding to the value on the vertical scale, proper alignment is achieved.

DESCRIPTION OF THE PREFERRED EMBODIMENTS

Figure 1:
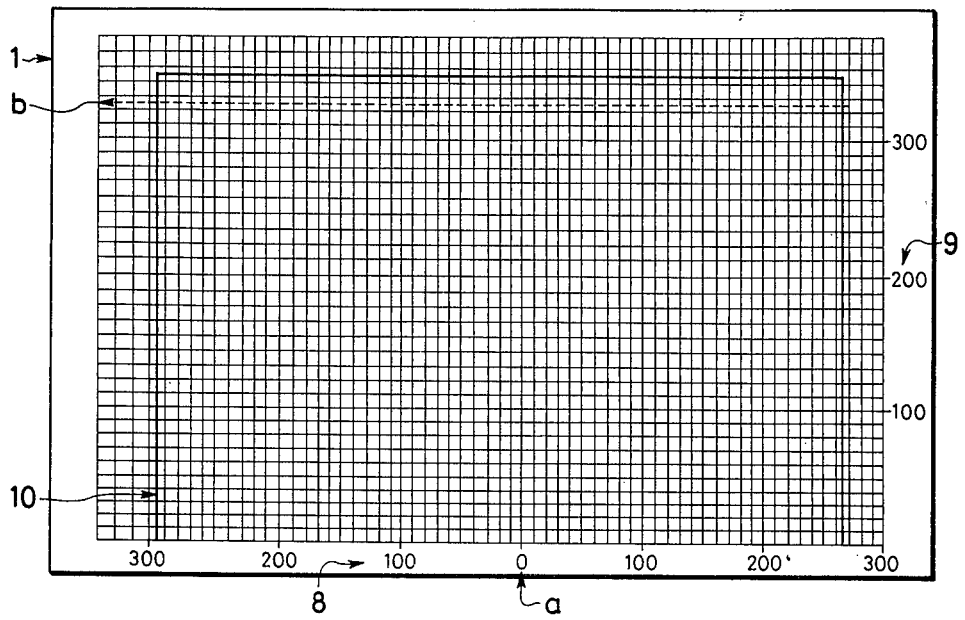
FIG. 1 is a plan view showing the manner in which a lateral perforating position reading plate of a lateral perforation vertical registration device for an offset press according to the present invention is placed on a printing paper.

The present invention will now be described in greater detail by way of examples shown in the drawings.

Figure 4:
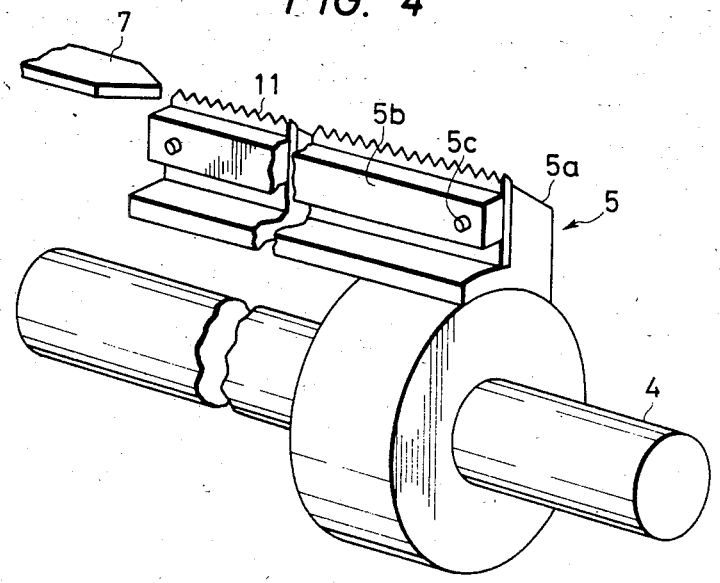
FIG. 4 is a perspective view of a lateral perforating device and a pointer of the device of the invention.

As shown in FIG. 1 and FIG. 4, the device of the present invention is constructed of a lateral perforating position reading plate 1, a vertical scale plate 3 fixedly mounted to a numbering device mounting cylinder shaft 2 and synchronized with a printing machine for rotation, a lateral perforating device 5 mounted to a lateral perforating device mounting shaft 4, and pointers 6 and 7 provided in association with the vertical scale plate 3 the lateral perforating device 5, respectively, and fixed to the frame of the printing machine.

As is clearly illustrated in FIG. 1, the lateral perforation position reading plate 1 carries a lateral scale 8 and a vertical scale 9. The lateral scale 8 extends laterally both to the right and left from the point O corresponding to the center line a of a printing paper 10. The lines of the vertical scale 9 extend at right angles to those of the scale 8.

The lateral perforation position reading plate 1 is in the form of a transparent plastic film or plate made of a material such as acrylic or polycarbonate or glass so that the paper 10 is visible when the plate 10 is placed thereon.

The vertical scale plate 3 is in the form of a disk and carries a vertical scale 3*a* on its outer peripheral surface. The vertical scale 3*a* is calibrated so as to correspond to the vertical scale 9 of the lateral perforating position reading plate 1.

Further, the numbering device mounting cylinder shaft 2 and the lateral perforating device mounting shaft 4 are rotatably mounted, extending parallel to one another, between the frames of the printing machine. A perforating blade 11 of a suitable length is axially provided on the lateral perforating device 5, fixed on the lateral perforating device mounting shaft 4. Namely, the perforating blade 11, the relative position of which corresponds to the value given by the vertical scale 3*a* at the pointer 6, is removably mounted between the side surface of a block 5 and a pressing plate 5*b* by means of screws 5*c*. The length radial extension of the edge of blade 11 is adjustable via screws 5*c*.

Thus, the vertical scale 3*a* of the vertical scale plate 3 may be adjusted to the printer 6 upon rotation thereof in its circumferential direction. Likewise, the perforating blade 11 of the lateral perforating device 5 may be adjusted to the pointer 7 upon rotation thereof. The point O of the vertical scale 3*a* on the vertical scale plate is adapted to correspond to the gripper end of the printing paper 10 in terms of timing.

Figure 3:
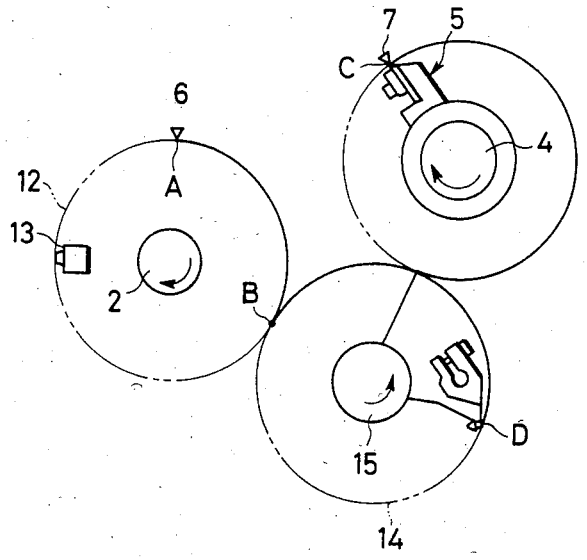
FIG. 3 shows the positional relationship between the respective scales of the device of the invention.

FIG. 3 illustrates the arrangement of the cylinders on which the lateral perforating device and the numbering device are mounted. As shown, the numbering device mounting cylinder shaft 2 carries a numbering device mounting cylinder 12 which is, in turn, provided with a number device 13. An impression cylinder 14 is provided on an impression cylinder shaft 15 rotatably provided between the frames of the printing machine, the peripheral surface of which is in contact with that of the numbering device mounting cylinder 12. The lateral perforating device 5 is provided on the lateral perforating device mounting shaft 4. The perforating blade 11 is fixedly mounted on the lateral perforating device 5 and projects therefrom so as to contact the peripheral surface of the impression cylinder 14. When the printing paper fed from the printing machine (not shown) is supplied between the lateral perforating blade 11 and the impression cylinder 14 and is then supplied between the numbering device mounting cylinder 12 and the impression cylinder 14, lateral perforation is effected on the printing paper by means of the lateral perforating device 5, and numbering is also effected thereon.

Figure 2:
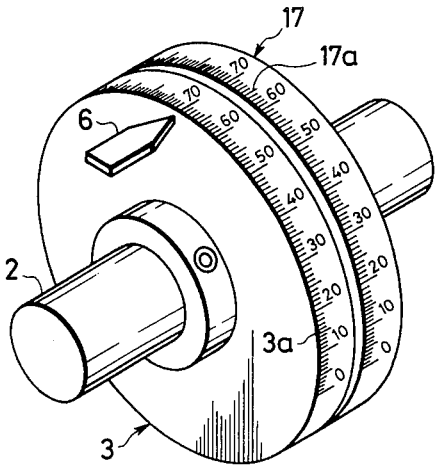
FIG. 2 is a perspective view of a vertical scale plate and a pointer of the device of the invention.

Fixedly mounted on the numbering device mounting cylinder shaft 2 is a vertical scale plate 17 positioned in close proximity to the vertical scale plate 3 and adapted to be used in connection with the numbering device as shown in FIG. 2. A vertical scale 17*a* is provided on its outer peripheral surface so that the numbering position may be registered upon adjustment thereof to the pointer 6.

Next, upon the registration of the numbering position and lateral perforating position, the relationship between the respective scales will be described with reference to FIG. 3.

In FIG. 3, when the distance between A and B is equal to that between B and D (A~B=B~D), the value read on the vertical scale 17*a* for numbering is zero, and the value read on the vertical scale 3*a* for lateral perforation is the distance between C and B minus that between A and B [(C~B)−(A~B)]. By so establishing the vertical scale 3*a* for the lateral perforation, adjustment of the perforating blade 11 to the pointer 7 may readily be effected.

In order to facilitate such adjustment, phase lag or lead of the scales 3*a* and 17*a* need not necessarily be considered. If the adjustment may readily be carried out, the same phase may be used, namely A~B=C~B. In this case, only the vertical scale 17*a* for the numbering position is necessary. Alternatively, the vertical scale 17*a* may be provided on the lateral perforating device mounting shaft.

After the registration of the lateral perforating position, the lateral perforation position reading plate 1 is placed on the printing paper 10 before lateral perforation is effected. At this time, the center A of the printing paper 10 is adjusted to the point zero of the lateral scale 8 on the lateral perforation position reading plate 1 so that both ends of the printing paper are at like values thereon.

Assuming that the line along which the lateral perforations should be formed is the line b indicated in FIG. 1, the vertical scale 3*a* is turned until the value b is read at the pointer 6. It should also be mentioned that the front end of the printing paper 10 should be aligned with the point zero of the vertical scale 9 upon setting the lateral perforation position.

After the position of the lateral perforation is read using the lateral perforation position reading plate, in the manner described above, the numbering mounting cylinder shaft 2 is rotated together with the vertical scale plate 3 so as to move the vertical scale 3*a* until the pointer 6 coincides with the value corresponding to the line b. In this state, the front end of the perforating blade 11 of the lateral perforating device 5 is adjusted so as to be aligned with the pointer 7, and the perforating device 5 is fixed at this point. The vertical registration of the lateral perforation is now completed.

The respective scales 8, 9, 3*a* and 17*a* may be graduated with distances. It will be noted, of course, that the smaller the distance of graduation, the higher the precision of the registration.

It will be also noted that the device according to the present invention may be used in association with a numbering registering device for an offset press such as disclosed in Japanese Utility Model Application No. 58-154096 filed by the present applicant. Upon such association, both numbering and lateral perforation may be effected by means of the vertical scale 3*a* and pointer 6.

With the lateral perforation vertical registration device for an offset press in accordance with the present invention constructed as described above, by placing the lateral perforation position reading plate 1 on the printing paper 10 and then adjusting the point on the vertical scale 9 to the front end of the printing paper 10, the position of lateral perforation may be read by the scale 9. Next, after setting the vertical scale 3*a* of the vertical scale plate 3 to the value b thus read and the perforating blade 11 of the lateral perforating device 5 to the pointer 7, the registration of lateral perforation in the vertical direction may be readily effected.

It is not necessary to prepare test sheets for checking the perforating position prior to actual operation. Also, registration may be done before lateral perforation is effected, thereby making the operation easier. Additionally, the registration may be precisely, rapidly and safely effected, thereby reducing the preparation time therefor. When used with a typographic numbering registration device, the registration of the lateral perforation and typographic numbering simultaneously may be done with only one vertical scale. Further, from the standpoint of construction, a smaller number of components is necessary, and therefore the manufacturing cost is reduced compared with the conventional device.

We claim:

1. A lateral perforation vertical registration device for an offset press comprising: a lateral perforation position reading plate made of a transparent material having a lateral scale and a vertical scale, said lateral perforation position reading plate being placed on a printing paper before lateral perforation is effected to determine a position of lateral perforation; a rotary numbering device mounting shaft carrying a numbering device; a first vertical scale mounted on said numbering device mounting shaft for indicating a perforation location; a rotary lateral perforating device mounting shaft mounted parallel to said numbering device mounting shaft; lateral perforating means having a perforating blade mounted on said lateral perforating device mounting shaft; an impression cylinder disposed between said numbering device mounting shaft and said lateral perforating device mounting shaft; a second vertical scale provided on an outer peripheral surface of said numbering device mounting shaft for indicating a numbering location; a first pointer fixedly mounted adjacent said first and second scales; and a second pointer fixedly mounted adjacent said lateral perforating means, the position of the first and second scales being relatively adjustable and said scales being fixedly connectable to said numbering device mounting shaft.

2. The lateral perforation vertical registration device of claim 1, wherein said second vertical scale fixed to said numbering device mounting shaft indicates the alignment of said numbering device relative to said lateral scale of said reading plate.

* * * * *